US006085390A

United States Patent [19]

Leifeld

[11] Patent Number: 6,085,390

[45] Date of Patent: Jul. 11, 2000

[54] DEVICE FOR ADJUSTING THE DISTANCE BETWEEN A ROLL AND A STATIONARY CARDING SEGMENT IN A FIBER PROCESSING MACHINE

[75] Inventor: Ferdinand Leifeld, Kempen, Germany

[73] Assignee: Trützschler GmbH & Co. KG, Mönchengladbach, Germany

[21] Appl. No.: 09/351,334

[22] Filed: Jul. 12, 1999

[30] Foreign Application Priority Data

Jul. 11, 1998 [DE] Germany ..... 198 31 139

[51] Int. Cl.[7] ..... D01G 15/12

[52] U.S. Cl. ..... 19/113; 19/98; 19/104

[58] Field of Search ..... 19/98, 99, 102, 19/103, 104, 105, 110, 111, 112, 113, 114

[56] References Cited

U.S. PATENT DOCUMENTS

| | | | |
|---|---|---|---|
| 2,879,549 | 3/1959 | Miller et al. | 19/113 |
| 3,858,276 | 1/1975 | Hollingsworth | 19/98 |
| 4,996,745 | 3/1991 | Sutcliffe | 19/104 |
| 5,918,349 | 7/1999 | Leifeld et al. | 19/103 |

FOREIGN PATENT DOCUMENTS

| | | |
|---|---|---|
| 0 422 838 | 4/1991 | European Pat. Off. . |
| 0 476 407 | 3/1992 | European Pat. Off. . |
| 39 13 996 | 8/1990 | Germany . |
| 42 35 610 | 4/1994 | Germany . |
| 0 801 158 | 10/1997 | Germany . |
| 196 51 891 | 6/1998 | Germany . |
| 196 51 893 | 6/1998 | Germany . |
| 196 51 894 | 6/1998 | Germany . |

*Primary Examiner*—Michael A. Neas
*Assistant Examiner*—Gary L. Welch
*Attorney, Agent, or Firm*—Venable; Gabor J. Kelemen

[57] ABSTRACT

A fiber processing machine includes a fiber processing roll carrying a roll clothing on a circumferential surface thereof; an operationally substantially stationary carding segment carrying a segment clothing for cooperating with the roll clothing along a circumferential length portion thereof; a strip-supporting component fixedly held on a machine frame and having a supporting surface; and a segment-supporting strip extending circumferentially along the roll and being held on the supporting surface of the strip-supporting component. The segment-supporting strip has an upper surface supporting the carding segment at opposite end portions thereof and a lower surface opposite the upper surface. A radial distance between the clothing points of the segment clothing and the clothing points of the roll clothing is determined and is changeable by the shape and/or the position of the segment-supporting strip.

20 Claims, 6 Drawing Sheets

FIG. 3a
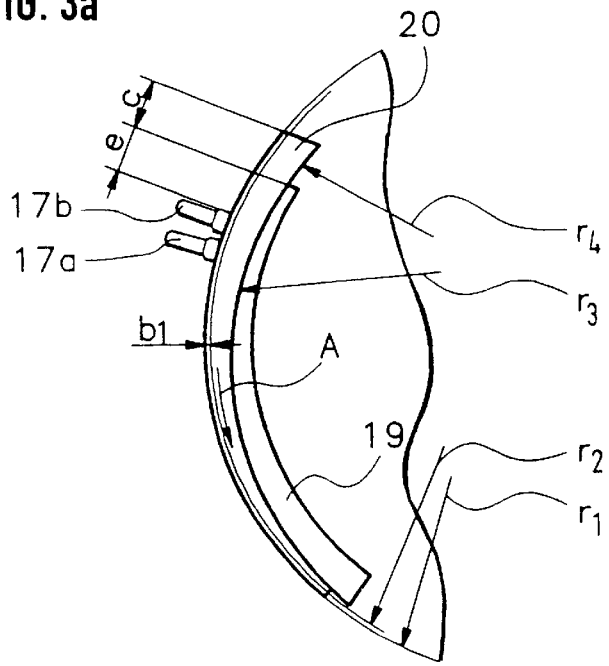
FIG. 3c
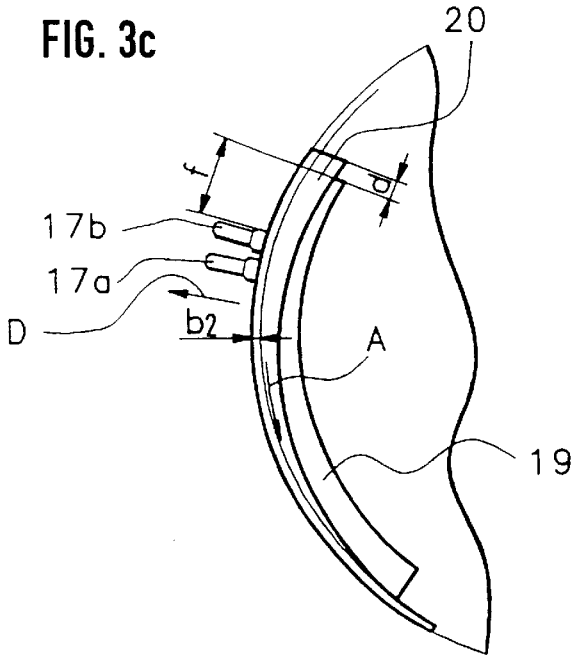
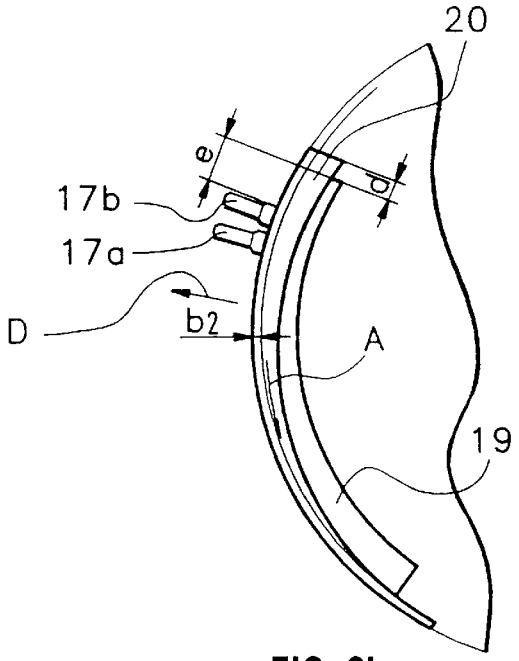
FIG. 3b

FIG. 4a
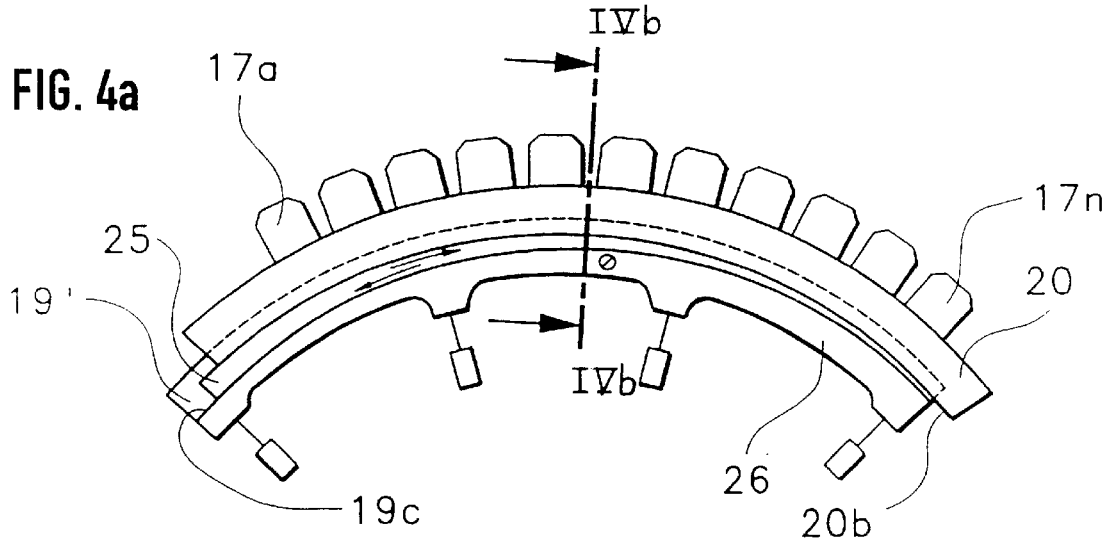
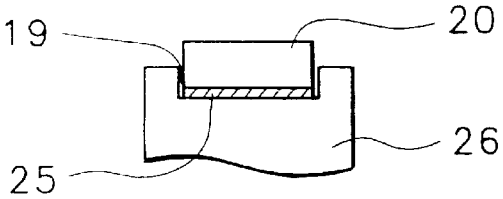
FIG. 4b
FIG. 5
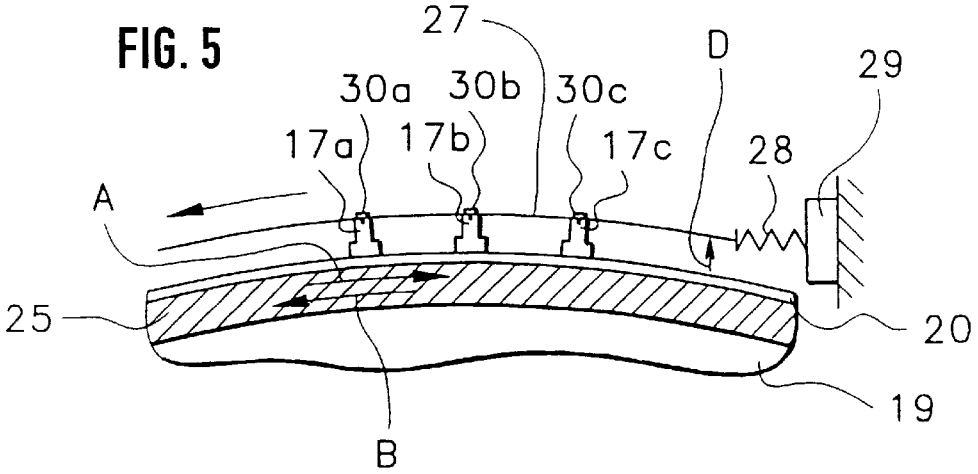

DEVICE FOR ADJUSTING THE DISTANCE BETWEEN A ROLL AND A STATIONARY CARDING SEGMENT IN A FIBER PROCESSING MACHINE

CROSS REFERENCE TO RELATED APPLICATION

This application claims the priority of German Application No. 198 31 139.7 filed Jul. 11, 1998, which is incorporated herein by reference.

BACKGROUND OF THE INVENTION

This invention relates to a device incorporated in a fiber processing machine such as a carding machine, a cleaner or the like and is of the type which has at least one operationally fixed carding segment which cooperates with the clothing of a rapidly rotating roll forming part of a fiber processing machine. The end portions of the carding segment are associated with adjusting means with which the radial distance between the roll clothing and the carding segment clothing may be varied.

In a known apparatus, as disclosed, for example, in published European Patent Application No. 0 422 838, the main carding cylinder of a carding machine is associated with a plurality of fixed carding segments, whose end portions are secured to the lateral frame of the carding machine. At each end of each carding segment a plate having an externally projecting attachment is provided which carries a securing (fixing) screw with a setting nut. By manually turning the setting nuts, the distance of the clothing of the carding segment relative to the cylinder clothing may be individually adjusted. Such a setting procedure by means of setting nuts to obtain a desired and uniform carding gap during the initial assembly of the carding machine or during a later readjustment is complicated. It is a further drawback of such an arrangement that an adjustment is possible only during standstill of the machine, resulting in an interruption of the production.

SUMMARY OF THE INVENTION

It is an object of the invention to provide an improved device of the above-outlined type from which the discussed disadvantages are eliminated and which, in particular, is structurally simple, is easy to assemble and makes possible a more accurate and more uniform adjustment and furthermore allows such adjustments, whereby a change of the carding intensity during normal operation of the carding machine may be performed.

This object and others to become apparent as the specification progresses, are accomplished by the invention, according to which, briefly stated, the fiber processing machine includes a fiber processing roll carrying a roll clothing on a circumferential surface thereof; an operationally substantially stationary carding segment carrying a segment clothing for cooperating with the roll clothing along a circumferential length portion thereof; a strip-supporting component fixedly held on a machine frame and having a supporting surface; and a segment-supporting strip extending circumferentially along the roll and being held on the supporting surface of the strip-supporting component. The segment-supporting strip has an upper surface supporting the carding segment at opposite end portions thereof and a lower surface opposite the upper surface. A radial distance between the clothing points of the segment clothing and the clothing points of the roll clothing is determined and is changeable by the shape and/or the position of the segment-supporting strip.

Thus, with the measures according to the invention it is possible to vary the carding intensity in a simple manner in response to changes of technological magnitudes, for example, the nep number and/or the fiber damage or when the fiber material to be processed changes. It is a further advantage of the invention that after a relocation of the segment-supporting strip, the uniform distance between the carding segment clothings, on the one hand, and the cylinder (roll) clothing, on the other hand, is maintained circumferentially uniform, resulting in a significant improvement in the produced sliver. Upon adjustment, the position of the convex outer face of the segment-supporting strip radially shifts. The flexibility (elasticity) of the segment-supporting strip ensures that the arcuate shape of the outer surface of the segment-supporting strip is adaptable to thus ensure, at all locations along the circumference, the uniformity of the distance between the carding segment clothings, on the one hand, and the cylinder clothing, on the other hand. It is a further advantage that the adjustment may be effected continuously, for example, during operation of the fiber processing machine. Such an adjustment may be effected automatically or by a manual, pushbutton operation and thus a time-consuming assembly work and an interruption in the production are avoided. It is of particular advantage that the convex outer surface of the segment-supporting strip on which the carding segments are positioned is, on each side of the machine, radially adjustable concentrically to the circumferential surface of the cylinder. In this manner an infinite number of supporting locations for the end regions of the carding segments may be steplessly adjusted.

By a carding segment there is meant in the present context a carrier element which is provided with a clothing and which is substantially stationary during operation. The carding segment is radially locally moved only if the carding gap is to be changed. Further, the carding segment, in accordance with a preferred embodiment of the invention, is displaced circumferentially together with the segment-supporting strip during adjustment. A desired change of the radial distance may be effected, for example, upon a change of the type of the processed fiber material, while a necessary change is effected, particularly during operation, because of an undesirably increasing nep number and/or a fiber shortening in the sliver. The apparatus according to the invention is preferably a component of a "selfadjusting" carding machine. The change in the type of fiber material may be effected as a function of stored data. A change as a function of the nep number and/or the fiber shortening is based on measured values.

The invention has the following additional advantageous features:

- The radial distance between the carding segment and the carding cylinder is determined by the radial thickness of the segment-supporting strip.
- The supporting surface and the underface of the segment-supporting strip are arcuate and extend parallel to one another.
- The supporting surface and the underside of the segment-supporting strip are arcuate and converge as viewed in one circumferential direction to lend the segment-supporting strip an elongated, wedge-shaped configuration.
- The segment-supporting strip is displaceable in the circumferential direction.
- The segment-supporting strip is replaceable.

The supporting surface of the strip-supporting component is a convex face of a side plate of the carding machine.

The supporting surface of the strip-supporting component extends parallel to a convexly arcuate face of a side plate of the carding machine.

The strip-supporting component has a longitudinally extending groove in which the segment-supporting strip is partially received.

The segment-supporting strip is a wear-resistant, low-friction flexible plastic.

The radial displacement of the supporting surface of the segment-supporting strip is approximately 0.01 to 0.3 mm.

The carding segment remains stationary during circumferential displacement of the segment-supporting strip.

The carding segment and the segment-supporting strip are displaced together circumferentially.

The adjustment of the radial distance is stepless.

The clothed roll is the main carding cylinder and/or the licker-in of a carding machine or the roll of a fiber opener or cleaner.

The stationary carding segments are biased against the segment-supporting strip, for example, by a spring, a tensioning band or the like.

The clothed roll (such as a carding cylinder) cooperates with a plurality of stationary carding segments.

The carding segment has two or more carding elements.

The adjusting device includes a driving mechanism such as a motor.

The adjusting device has setting elements such as levers, a toothed rack, gears, rotary joints and the like.

The adjusting device exerts its force essentially to the middle of the segment-supporting strip.

The segment-supporting is provided with teeth at least along one part of its length for meshing with a gear of the motor drive.

The motor drive is connected with an electronic control and-regulating device, such as a microcomputer.

A measuring member is connected to the electronic control-and-regulating device for detecting the fiber length of the fibers processed by the fiber processing machine.

A measuring member detecting the nep number is connected with the electronic control-and-regulating device.

A measuring member for detecting the distance between the carding element clothing and the roll clothing is connected with the electronic control-and-regulating device.

A switching element for actuating the drive of the adjusting device is connected to the electronic control-and-regulating device.

An inputting element for the measuring values of the fiber length is connected to the electronic control-and-regulating device.

The segment-supporting strip and the strip-supporting component are wedge-shaped as viewed circumferentially and are oppositely oriented.

The carding gap may be set to be constant.

The carding gap may be set to be conically tapering.

The convex outer surface of the segment-supporting strip has a contour which has a circular, circumferential portion and an inclined portion or a depression.

BRIEF DESCRIPTION OF THE DRAWINGS

FIG. 3*a* is a schematic side elevational view of one part of a carding cylinder showing two carding segments supported in a first position by a device according to the invention.

FIG. 3*b* is a view similar to FIG. 3*a*, showing the segment-positioning device in a second position in which the two carding segments are only radially shifted.

FIG. 3*c* is a view similar to FIG. 3*a*, showing the segment-positioning device in a second position in which the two carding segments are radially and circumferentially shifted.

FIG. 4*a* is a schematic side elevational view of a flexible bend supporting the segment-adjusting device according to the invention.

FIG. 4*b* is a sectional view taken along line IVb—IVb of FIG. 4*a*.

FIG. 5 is a schematic sectional side elevational view of a further preferred embodiment of the invention.

DESCRIPTION OF THE PREFERRED EMBODIMENTS

Figure 1:
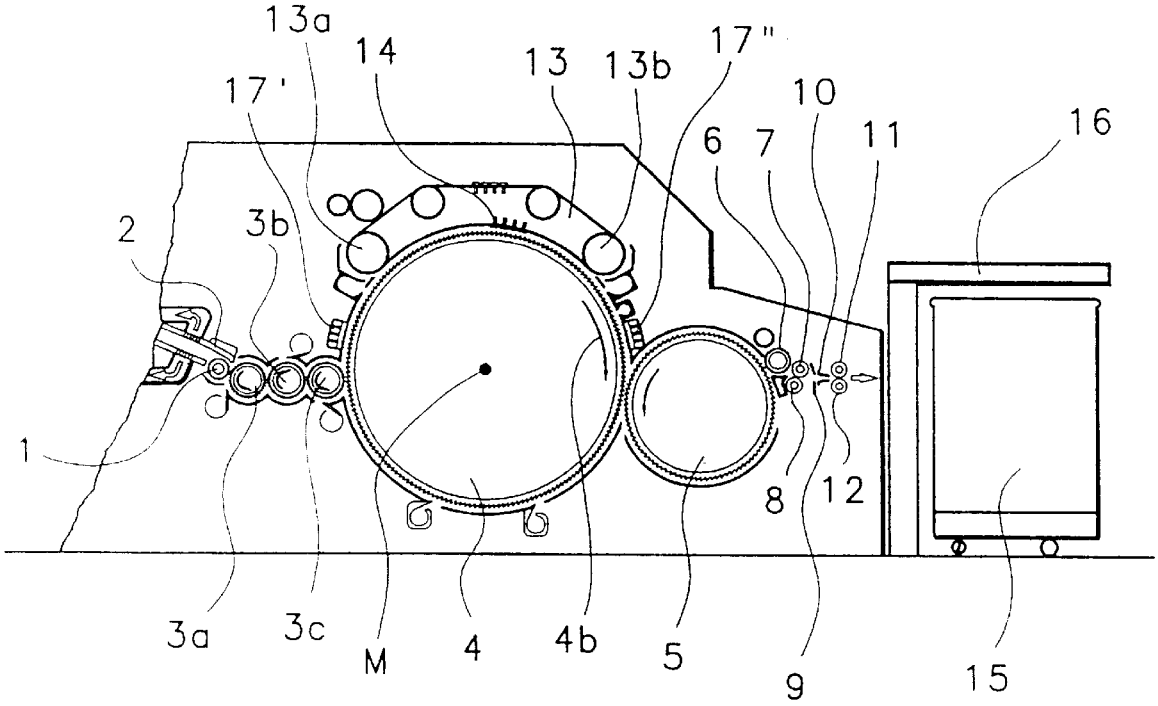
FIG. 1 is a schematic side elevational view of a carding machine incorporating the device according to the invention.

FIG. 1 illustrates a carding machine which may be, for example, an EXACTACARD DK 803 model manufactured by Trützschler GmbH & Co. KG, Möbnchengladbach, Germany. The carding machine has a feed roll 1 cooperating with a feed tray 2, licker-ins 3*a*, 3*b*, 3*c*, a main carding cylinder 4, a doffer 5, a stripping roll 6, crushing rolls 7, 8, a web-guiding element 9, a sliver trumpet 10, calender rolls 11, 12, a traveling flats assembly 13 having flat bars 14, a coiler can 15, a sliver coiler 16 and stationary carding segments 17' and 17" positioned by a segment-adjusting device according to the invention. The direction of rotation of the various rotary members is shown by curved arrows drawn therein. The carding segment 17' is positioned between the licker-in 3*c* and the rearward end sprocket 13*a* of the traveling flats assembly 13 while the carding segment 17" is situated between the doffer 5 and the frontal end sprocket 13*b* of the traveling flats assembly 13.

Figure 2:
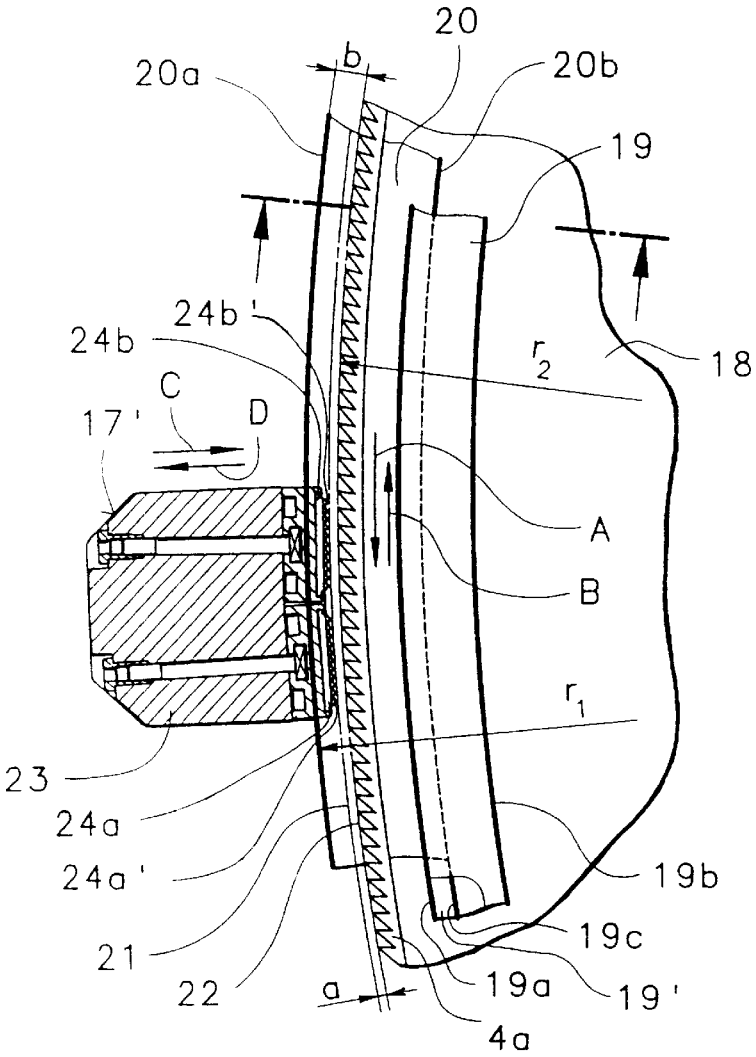
FIG. 2 is a schematic sectional side elevational view illustrating one part of a carding cylinder, cooperating with a stationary carding segment positioned by a device according to the invention.
Figure 2A:
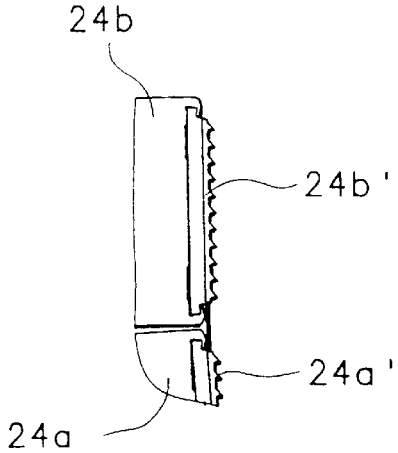
FIG. 2*a* is an enlarged side elevational detail of FIG. 2.

Turning to FIG. 2, on each side of the carding machine an approximately semicircular rigid side plate 18 is secured to the non-illustrated machine frame. To the external face of each side plate, in the region of its periphery, an arcuate, rigid strip-supporting component 19 is affixed which is concentric with the rotary axis M of the main carding cylinder 4. The strip-supporting component 19 has an upper, convex supporting surface 19*a* and an underside 19*b*. On the strip-supporting component 19 a flexible, segment-supporting strip 20 is positioned which is preferably made of a low-friction, wear-resistant plastic. The segment-supporting strip 20 has a convex supporting face 20*a* and a concave underface 20*b* which is positioned on the convex supporting surface face 19*c* in a circumferential groove 19' of the strip-supporting component 19. The segment-supporting strip 20 may be shiftable with respect to the strip-supporting component 19 in the direction of arrows A, B. The displacement of the segment-supporting strip 20 is effected by a displacing device which includes a drive such as a motor, a gearing or the like, as will be described later, in conjunction with FIG. 7. The carding segment 17' has, at opposite ends, engagement faces which lie on the convex surface of the respective segment-supporting strip 20 (only one is visible in FIG. 2). The underside of a carrier 23 forming part of the carding segment 17' carries circumferentially consecutive carding elements 24*a*, 24*b* having respective carding clothings 24*a*' and 24*b*'. An imaginary circle on which the clothing points of the carding elements 24*a* and 24*b* lie is designated at 21. The main carding cylinder 4 carries on its circumference a cylinder clothing 4*a*, for example, a sawtooth clothing, oriented toward the segment clothings 24*a*', 24*b*'. An imaginary circle circumscribable about the clothing points of the cylinder clothing 4*a* is designated at 22. The radial distance between the circles 21 and 22 is designated at a and amounts to, for example, 0.20 mm. The distance between the convex outer face 20*a* and the circle 22 is designated at b. The radius of the convex outer face 20*a* is designated at $r_1$, while the radius of the circle 22 is designated at $r_2$. The radii $r_1$ and $r_2$ intersect in the rotary axis M of the carding cylinder 4.

As further illustrated in FIG. 2, the elongated wedge-shaped segment-supporting strip 20 is displaceable in the direction of the arrows A, B on the groove bottom 19*c* whereby the carding segment 17' is displaced radially in the direction of the arrows C or D. The distance a between the carding element clothings 24*a*' and 24*b*' on the one hand and the cylinder clothing 4*a* on the other hand is thus adjustable in a simple and accurate manner.

In FIGS. 3*a*, 3*b* and 3*c* the displacement of the segment-supporting strip 20 on and with respect to the strip-supporting component 19 occurs in the direction of the arrow A. By virtue of the displacement of, for example, 50 mm, the distance b between the points of the clothings 24*a*' and 24*b*', on the one hand, and the clothing points of the cylinder clothing 4*a*, on the other hand, that is, the distance b between the two imaginary circles 21 and 22 is increased from $b_1$ (FIG. 3*a*), for example, 0.30 mm, to $b_2$ (FIGS. 3*b* and 3*c*), for example, 0.50 mm. The radius of the convex outer face of the groove bottom 19*c* of the strip-supporting component 19 is designated at $r_3$ and the radius of the concave inner surface 20*b* of the segment-supporting strip 20 is designated at $r_4$. By virtue of the displacement of the segment-supporting strip 20 in the direction A, the carding segments 17*a*, 17*b* of FIGS. 3*a*, 3*b*, 3*c* are shifted in the direction of the arrow D radially with respect to the carding cylinder 4, so that the distance between the clothing of the segments and the clothing of the carding cylinder is increased from a to b. In FIG. 3*a* the initial position is shown where between one end of the segment5 supporting strip 20 and one end of the strip-supporting component 19 a distance c prevails. According to FIGS. 3*b* and 3*c*, after the displacement of the segment-supporting strip 20 in the direction A, between one end of the segment-supporting strip 20 and one end of the strip-supporting component 19 only a smaller distance d is still present. As shown in FIG. 3*b*, only the segment-supporting strip 20 is displaced in the direction A, while the carding segments 17*a*, 17*b* do not move in the circumferential direction, that is, the distance e between one end of the strip-supporting component 19 and the carding segments 17*a*, 17*b* remains the same. The carding segments are, by means of a holding and loading element, for example, a tensioning band (FIG. 5), a tension spring or the like, held fixedly with respect to the circumferential direction. The elastic holding and securing element, however, makes possible to displace the carding segments 17*a*, 17*b* in the direction D. According to FIG. 3*c*, the segment-supporting strip 20 and the carding segments 17*a*, 17*b* are shifted together in the direction A, that is, the distance e shown in FIG. 3*b* is increased to the distance f shown in FIG. 3*c*. The carding segments 17*a*, 17*b* are entrained to a certain extent by the segment-supporting strip 20 in the direction A. In such a case only one securing element, for example, a spring or the like is required which frictionally or form-fittingly connects the carding segments 17*a*, 17*b* with the segment-supporting strip 20.

As shown in FIG. 4*a*, within the groove 19', between the concave inner face 20*b* of the segment-supporting strip 20 and the groove bottom 19*c* of the strip-supporting component constituted by a flexible bend 26, a displaceable, wedge-shaped intermediate strip 25 is provided which is made of a flexible material, such as a plastic. The segment-supporting strip 20 extends parallel to the intermediate strip 25 and is made of a flexible plastic material as well. The flexible bend of the carding machine is designated at 26. FIG. 4*a* shows the flats zone of a fixed-flats carding machine which, in contrast to FIG. 1, has no traveling flats assembly 13. Rather, a series (more than two) of carding segments 17*a*–17*n* is provided.

As shown in FIG. 5, a tensioning band 27 made, for example, of plastic, steel or the like is provided which is secured at one end to a stationary support 29 by a tension spring 28. The other end of the tensioning band 27 is secured to another, non-illustrated support. The carding segments 17*a*, 17*b* and 17*c* are attached by securing elements, for example, screws 30*a*, 30*b* and 30*c*, to the tensioning band 27. As a result, the carding elements 17*a*, 17*b* and 17*c* are pressed against the segment-supporting strip 20, and upon displacement of the latter, they are held stationarily to prevent them from moving circumferentially, but to shift only in the direction of the arrow D.

Figure 6:
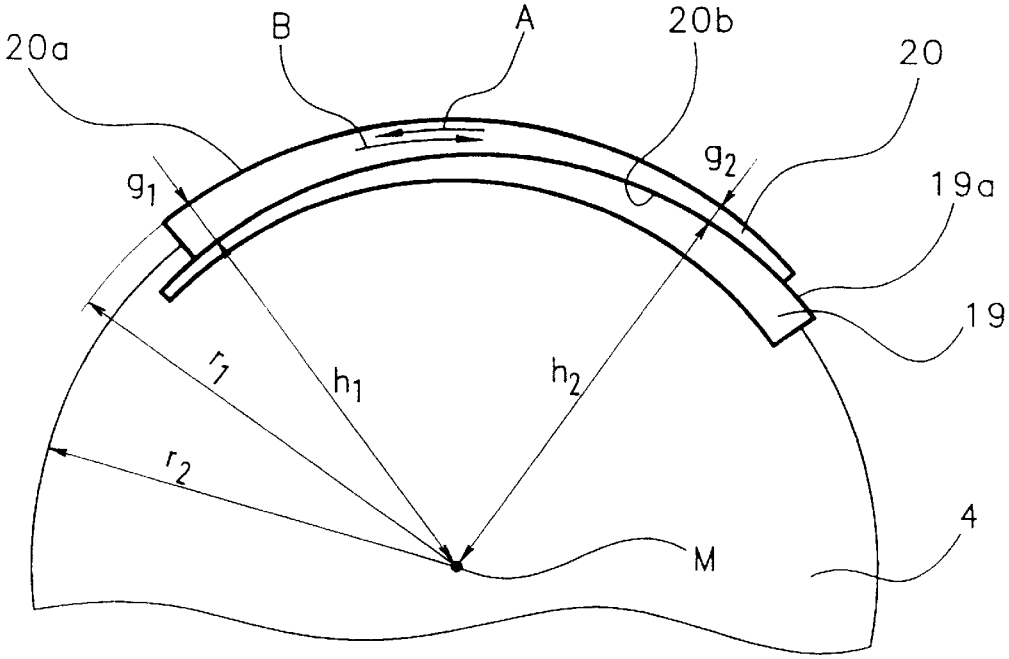
FIG. 6 is a schematic side elevational view of a segment-supporting device according to the invention, having a wedge-shaped segment-supporting strip and a wedge-shaped strip-supporting component.

FIG. 6 shows schematically the strip-supporting component 19 together with the segment-supporting strip 20 shiftable thereon. The distance between the convex outer surface 20*a* and the convex inner surface 20*b* decreases circumferentially as viewed in the direction B from gi to $g_2$ and the distance between the convex outer surface 19*a* and the rotary axis M of the carding cylinder 4 increases circumferentially as viewed in the direction B from $h_1$ to $h_2$ so that the sum of the two distances $g_1$, $h_1$ and, respectively, $g_2$, $h_2$ is constant at all locations along the circumference. The concave inner face 20*b* and the convex outer face 19*a* are in a gliding contact with one another. The center of curvature of the concave inner face 20*b* and the center of curvature of the convex outer face 19*a* lies externally of the axis M of the carding cylinder 4.

Figure 7:
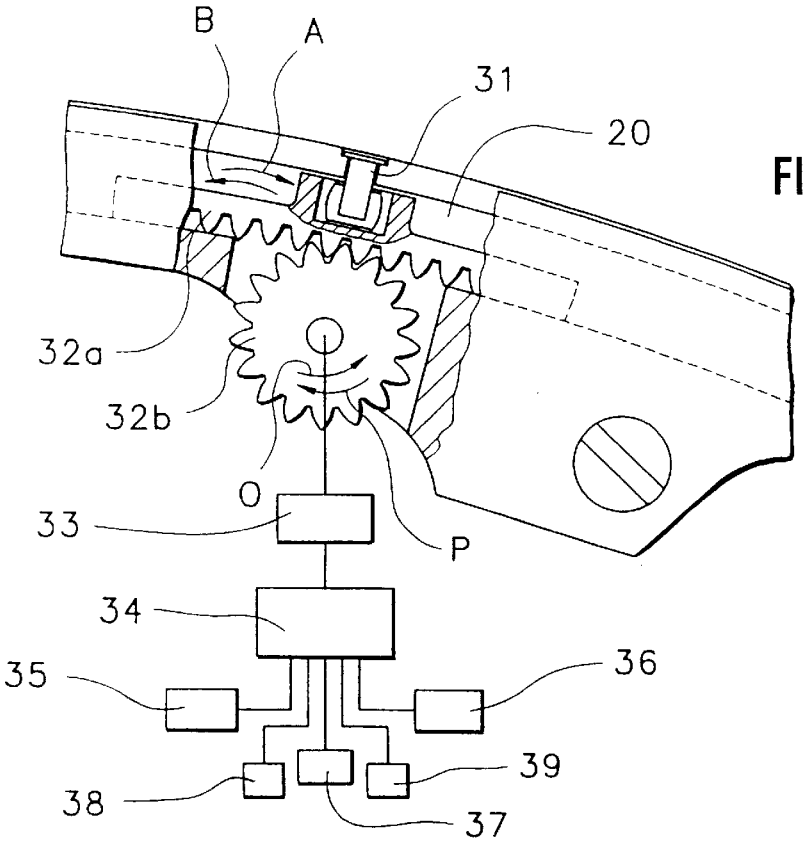
FIG. 7 is a schematic, partially sectional side elevational view of an adjusting drive according to the invention, also illustrating a block diagram for its control.

Turning to FIG. 7, to the segment-supporting strip 20 a carrier pin 31 is secured which is coupled with a toothed rack 32*a*. The latter, in turn, meshes with a gear 32*b* rotatable in the direction O or P. The gear 32*b* is driven by a driving device 33, for example, a reversible motor, whereby the segment-supporting strip 20 may be shifted in the direction of the arrows A, B.

An electronic control-and-regulating device 34, for example, a microcomputer is provided to which there are connected a measuring member 35 for an automatic detection of the nep number, a measuring member 36 for detecting the fiber length and a setting member, for example, the drive motor 33. The measuring member 35 may be, for example, a NEPCONTROL NCT model, manufactured by Trutzschler GmbH & CO. KG. The measuring values for the fiber length which, for example, may be determined by a fibograph, may be inputted by an inputting device 37 into the electronic control-and-regulating device 34. Further, a switching element 38, for example, a pushbutton or the like may be connected to the electronic control-and-regulating device 34 for actuating the motor 33. Further, a measuring member 39, for example, a FLATCONTROL FCT (manufactured by Trutzschler GmbH & CO. KG) for detecting the distance a between the points of the clothings 24*a*', 24*b*' on the one hand, and the points of the carding cylinder clothing 4*a*, on the other hand, may be connected to the electronic control-and-regulating device 34. The types of fiber material to be processed may be stored in a memory which, for example, is integrated into the microcomputer 34.

Figure 8A:
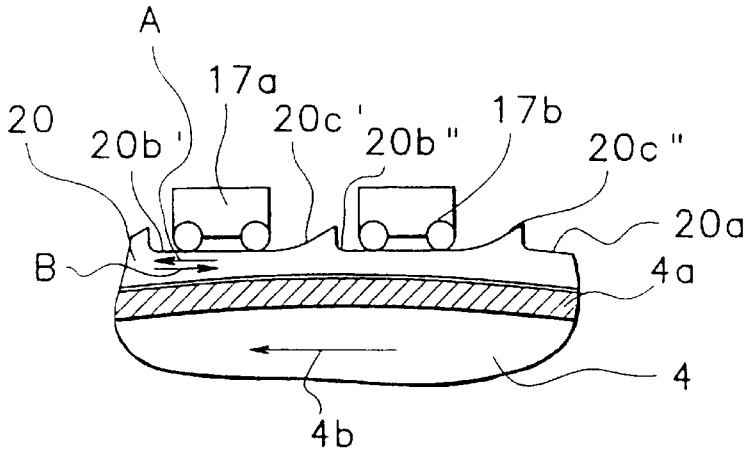
FIGS. 8*a* and 8*b* are schematic side elevational views of yet another preferred embodiment of the invention for an oblique positioning of the carding segments, shown in two operational positions.
Figure 8B:
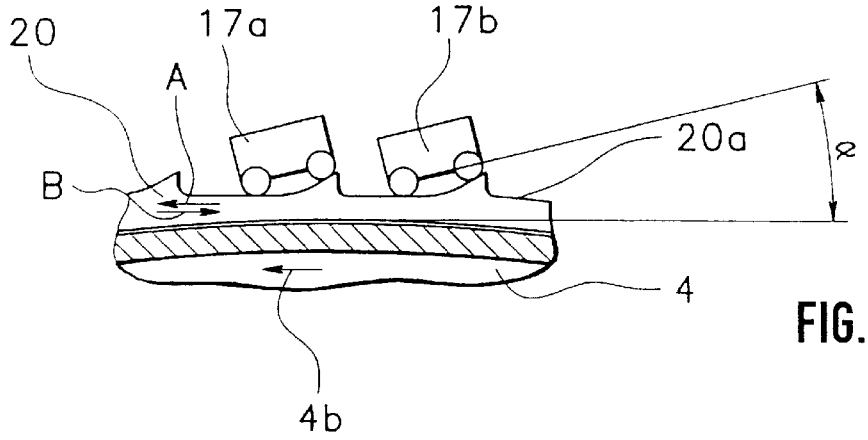

Turning to FIGS. 8*a* and 8*b*, the convex outer surface 20*a* of the segment-supporting strip 20 has a particularly shaped contour which is provided with cutouts having surface portions 20*b*', 20*b*" which extend substantially parallel to the surface of the carding cylinder 4 and surface portions 20*c*' and 20*c*" which extend at an inclination to the surface portions 20*b*' and 20*b*41 . As shown in FIG. 8*a*, the carding segments 17*a*, 17*b* are initially set such that the carding clearance a, that is, the distance between the carding segment clothings 24*a*', 24*b*', on the one hand, and the carding cylinder clothing 4*b*, on the other hand, is constant. It has been shown in practice that after a certain period of operation, the first teeth of the carding segment clothings 24*a*', 24*b*' (as viewed in a direction opposite to the rotational direction 4*b* of the carding cylinder 4) undergo a more substantial wear than the other teeth. Therefore, according to FIG. 8*b*, the segment-supporting strip 20 is shifted in the direction A, so that the region of the carding segments 17*a*, 17*b* having the worn teeth, glides upwardly on one oblique surface 20*c*', 20*c*" and thus the carding clearance with respect the carding cylinder clothing 4*a* assumes an angle $\alpha$ which is open in a direction opposite to the direction 4*b*. In this manner, the worn teeth will have a lesser or no penetration into the fiber material, and the lesser worn or not worn teeth of the carding segment clothings 24*a*' and 24*b*' are then utilized for the carding work.

Figure 9:
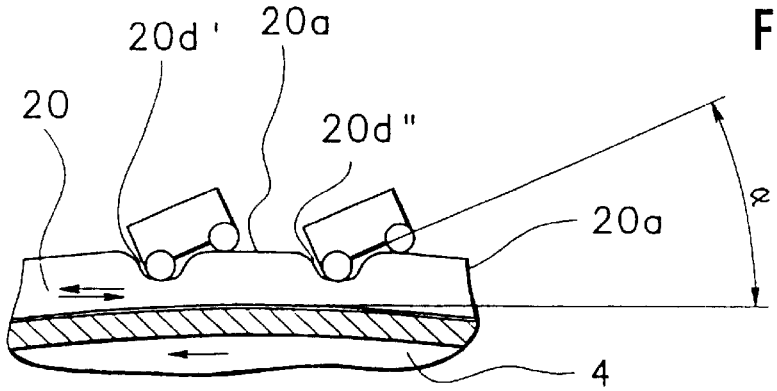
FIG. 9 is schematic, partially sectional side elevational view of a further embodiment of the invention for an oblique positioning of the carding segments.

The inclined setting of the carding segments 17*a*, 17*b* at an angle $\alpha$ may be effected according to the embodiment shown in FIG. 9 by providing depressions (dips) 20*d*', 20*d*" in the surface 20*a* of the segment-supporting strip 20.

It will be understood that the above description of the present invention is susceptible to various modifications, changes and adaptations, and the same are intended to be comprehended within the meaning and range of equivalents of the appended claims.

What is claimed is:

1. A fiber processing machine comprising (a) a fiber processing roll having a roll axis and carrying a roll clothing on a circumferential surface thereof; said roll clothing having clothing points;

(b) an operationally substantially stationary carding segment carrying a segment clothing and having end portions; said segment clothing cooperating with said roll clothing along a circumferential length portion thereof;

(c) a strip-supporting component fixedly held on a machine frame and having a supporting surface; and (d) a segment-supporting strip extending circumferentially along said roll and being at least indirectly held on said supporting surface of said strip-supporting component; said segment-supporting strip having an upper surface supporting said carding segment at said end portions thereof and a lower surface opposite said upper surface; a radial distance between said clothing points of said segment clothing and said clothing points of said roll clothing being determined and being changeable by one of a shape and position of said segment-supporting strip.

2. The fiber processing machine as defined in claim 1, wherein said radial distance is determined by a radial dimension of said segment-supporting strip.

3. The fiber processing machine as defined in claim 1, wherein said upper and lower surfaces of said segment-supporting strip are arcuate and extend parallel to one another.

4. The fiber processing machine as defined in claim 1, wherein said upper and lower surfaces of said segment-supporting strip are arcuate and converge as viewed in a circumferential direction of said roll.

5. The fiber processing machine as defined in claim 1, further comprising means for tensioning said carding segment against said segment-supporting strip.

6. The fiber processing machine as defined in claim 1, further comprising a circumferentially extending groove provided in said strip-supporting component; said segment-supporting strip being partially received in said groove.

7. The fiber processing machine as defined in claim 1, wherein said segment-supporting strip is a flexible plastic.

8. The fiber processing machine as defined in claim 1, further comprising an electronic control-and-regulating device and further wherein at least one of a sensor for measuring a length of fiber processed by the fiber processing machine, a sensor for measuring a nep number of the fiber, and a sensor for measuring said radial distance is connected to said electronic control-and-regulating device.

9. The fiber processing machine as defined in claim 1, further comprising an electronic control-and-regulating device and an inputting device for applying fiber length data to said electronic control-and-regulating device.

10. The fiber processing machine as defined in claim 1, wherein said radial distance when set varies as viewed circumferentially.

11. The fiber processing machine as defined in claim 1, wherein said radial distance when set is constant as viewed circumferentially.

12. The fiber processing machine as defined in claim 1, wherein said supporting surface of said segment-supporting strip has a substantially circumferentially extending first portion and a second portion adjoining and inclined with respect to said first portion, whereby said segment clothing, when said carding segment is supported partially by said first portion and partially by said second portion, is oriented at an inclination to said roll clothing.

13. The fiber processing machine as defined in claim 1, wherein said supporting surface of said segment-supporting strip has a substantially circumferentially extending first portion and a second portion adjoining said first portion and forming a dip in said first portion, whereby said segment clothing, when said carding segment is supported partially by said first portion and partially by said second portion, is oriented at an inclination to said roll clothing.

14. The fiber processing machine as defined in claim 1, further comprising shifting means for circumferentially displacing said segment-supporting strip relative to said strip-supporting component.

15. The fiber processing machine as defined in claim 14, further comprising means for preventing a circumferential displacement of said carding segment during a circumferential displacement of said segment-supporting strip.

16. The fiber processing machine as defined in claim 14, wherein said shifting means includes means for exerting a shifting force to said segment-supporting strip substantially at mid length thereof.

17. The fiber processing machine as defined in claim 14, wherein said shifting means comprises a motor and coupling means for connecting said motor to said segment-supporting strip.

18. The fiber processing machine as defined in claim 17, wherein said coupling means comprises a toothed rack carried by said segment-supporting strip and a gear rotatably coupled to said motor; further wherein said gear meshes with said toothed rack.

19. The fiber processing machine as defined in claim 14, further comprising an electronic control-and-regulating device; said shifting means being connected to said electronic control-and-regulating device.

20. The fiber processing machine as defined in claim 19, wherein said shifting means comprises a switch connected to said electronic control-and-regulating device.

* * * * *